United States Patent [19]

Cerrato

[11] 4,260,074

[45] Apr. 7, 1981

[54] METHOD AND APPARATUS FOR DISPENSING BEER THROUGH A GAS LINE

[75] Inventor: Vincent J. Cerrato, Pomona, N.Y.

[73] Assignee: Vending Components Inc., Hackensack, N.J.

[21] Appl. No.: 92,649

[22] Filed: Nov. 9, 1979

[51] Int. Cl.[3] ..... B67D 3/04

[52] U.S. Cl. ..... 222/1; 222/481.5

[58] Field of Search ..... 222/184, 185, 529, 464, 222/478, 481, 1, 481.5

[56] References Cited

U.S. PATENT DOCUMENTS

| | | | |
|---|---|---|---|
| 2,589,622 | 3/1952 | McCabe | 222/481.5 |
| 3,206,084 | 9/1965 | Reid et al. | 222/481 |
| 4,228,929 | 10/1980 | Gross | 222/185 |

*Primary Examiner*—Stanley H. Tollberg

*Attorney, Agent, or Firm*—John M. Calimafde; Roy C. Hopgood; Charles W. Neill

[57] ABSTRACT

This invention relates to dispensing beer, or the like, by gravity from beer kegs such as are often used for picnics. The keg is turned upside down and the down tube for the beer is used as a tube for admitting air or gas into the keg above the beer while the gas passages are used for the flow of beer to a faucet outside the keg. Supports hold the keg upside down and with the lowermost end of the keg spaced far enough above its ultimate supporting surface to permit access for an operator's hand to a valve actuator that opens and closes the vent. A hose line for beer leads from a branch conduit of the valve to a beer faucet beyond the sides of the inverted keg.

6 Claims, 3 Drawing Figures

METHOD AND APPARATUS FOR DISPENSING BEER THROUGH A GAS LINE

BACKGROUND AND SUMMARY OF INVENTION

Beer is ordinarily dispensed from beer kegs by gas pressure within the keg. The outlet for the beer is usually at the top of the keg and the outlet is a down tube that extends to a location near the bottom of the keg so that gas pressure on the surface of the beer in the keg displaces the beer upward through the down tube to an outlet at the upper end of the keg.

When beer is dispensed at locations where gas under pressure cannot be maintained in the keg, for example at outdoor picnics, it is usual to turn the keg upside down so that the beer runs out of the keg by gravity. This invention provides a valve construction by which the valve assembly at the top of the keg has a gas inlet and a beer outlet, but the construction is such that when the beer keg is turned upside down, the beer runs out by gravity through a hose line that would otherwise be used as a compressed gas inlet to the keg, and there is another valve that can be adjusted to let atmospheric air enter the upside down keg and flow upward through the "down tube" to supply air to the space in the keg above the beer to replace beer that flows from the low end of the keg through the usual gas inlet passage.

While the invention is primarily used for beer, the assembly can be used for other beverages, if desired, and other advantages and features will appear or be pointed out as the description proceeds.

BRIEF DESCRIPTION OF THE DRAWING

In the drawing forming a part hereof in which like reference characters indicate corresponding parts in all the views.

DESCRIPTION OF PREFERRED EMBODIMENT

Figure 1:
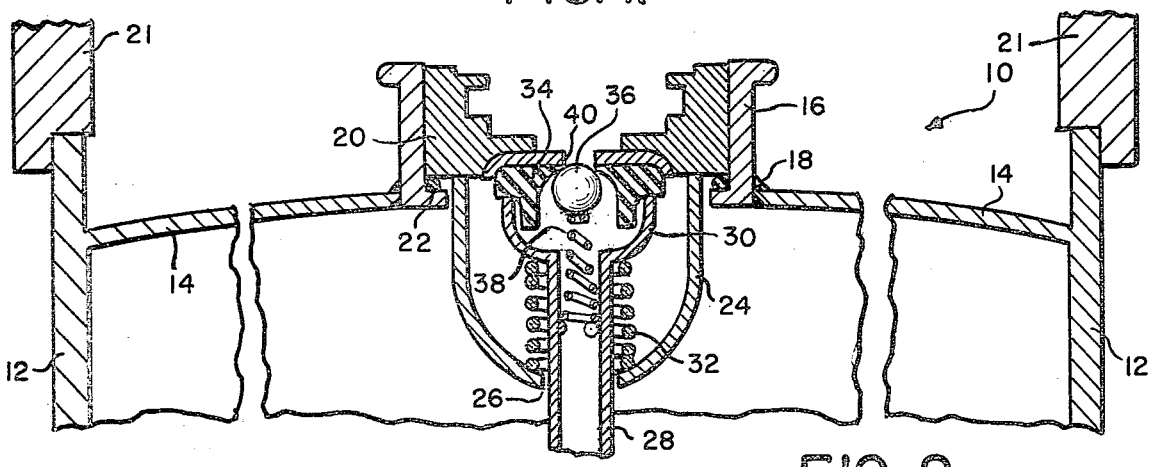
FIG. 1 is a diagrammatic view of the upper end of a beer keg and the valve construction for sealing the keg closed.

FIG. 1 is a diagrammatic drawing of the construction at the top end of a beer keg 10 which has a cylindrical sidewall 12 and a top 14 with a Barnes neck 16 which surrounds a center opening in the top 14. The Barnes neck 16 is secured to the top 14 by welding 18.

A keg fitting 20 is inserted into the Barnes neck 16 and has a sealing ring 22 which prevents leakage of gas or beer from the inside of the keg 10 along any clearance between the inside surface of the Barnes neck 16 and the outside surface of the fitting 20.

Legs 21 extend upward from the top of the keg 10 for supporting the keg 10, when upside down, from the ground, table, or other support, with the fitting 20 spaced from the underlying support far enough for an operator to reach under the keg to operate a purge fitting as will be explained.

A housing 24 is secured to the lower end of the fitting 20 as an integral part thereof. There is an opening 26 in the lower part of the housing 24, and a down tube 28 extends through the opening 26 into a location adjacent to the bottom of the keg 10. The down tube 28 has an enlarged diameter portion 30 and there is a compression spring 32 compressed between the lower end of the housing 24 and the outside surface of the enlarged diameter portion 30 of the down tube.

A valve seat 34 is secured to the upper edge of the enlarged diameter portion 30 of the down tube and this valve seat is preferably made of rubber which seals the space between the upper end of the enlarged portion 30 of the down tube and the face of the fitting 20 which confronts the upper end of the enlarged portion 30 of the down tube 28.

A spherical valve 36 is pressed against a valve seat on the center opening through the upper valve seat 34 and the surface of the spherical valve element 36 is urged into contact with the inside of the valve seat 34 by a tapered compression spring 38. The upper end of the spring 38 contacts with the spherical valve element 36, and the lower end of the spring 38 contacts with the enlarged diameter portion 30 of the down tube 28.

FIG. 1 shows the keg 10 sealed by the compression spring 32 which holds the down tube against the valve seat 34 and the valve seat in contact with the lower surface of the fitting 20. At the same time, the tapered compression spring 38 holds the spherical valve element 36 in contact with the seat provided by the walls of an opening 40 at the center of valve seat 34.

Figure 2:
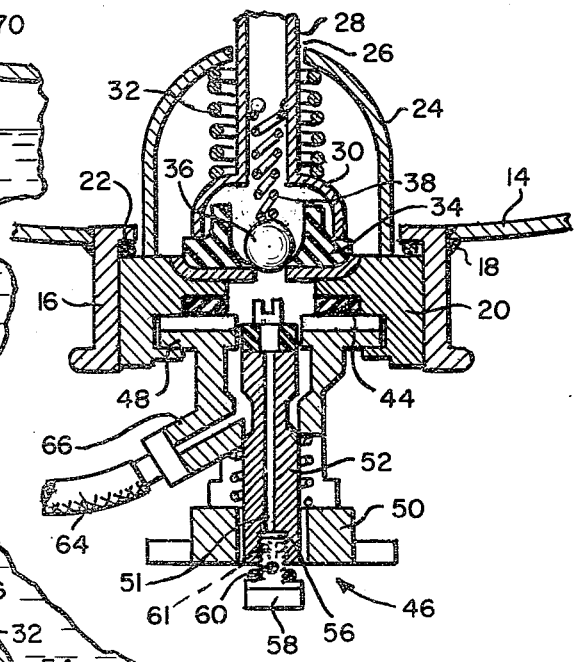
FIG. 2 is a fragmentary view showing the valve at the upper end of FIG. 1 and a tap connected with the fitting and the keg turned upside down.

FIG. 2 shows the same structure as FIG. 1 upside down and with a tap 46 which has projections 44 that make a bayonet type connection of the tap 46 with the fitting 20 by projecting under structure 48 of the fitting 20. The tap 46 is of conventional construction in that it has a handle 50 which rotates about an axis of the tap with cam slots that move the handle 50 downward when rotated in one direction. The tap 46 also includes a plunger 52 which moves upward and downward as a unit with the handle 50. There is an axial opening 51 extending lengthwise of the plunger 52 but this opening is not closed at the lower end by the spherical valve element 36 because there is a cross slot in the bottom face of the plunger 52 and this leaves the axial opening through the plunger 52 in communication with the down tube 28 when the plunger 52 is in contact with the spherical valve element 36.

At one end of the axial opening 51 through the plunger 52 there is an enlarged cross section of the axial opening indicated by the reference character 56 and a plug 58, with "o" ring, screws into the enlarged opening 56 to close the axial opening through the plunger 52 when the plug is screwed further into the enlarged opening 56.

The plug 58 has a cross drilling 60 near its lower end and there is an axial drilling 61 through the lower end of the plunger 52 which communicates with the cross drilling 60. When the plug 58 is screwed down far enough so that the cross drilling is below the end of the plunger 52, the plug 58 closes the axial opening through the plunger 52, but when the plug 58 is screwed up far enough to bring the cross drilling above the enlarged opening 56, the axial opening through the plunger 52 is open at both ends.

Gas for maintaining pressure in the keg is supplied through a hose 64 which flows through a branch passage 66 which communicates with clearance in the tap around the outside of the plunger 52 and around the outside of the down tube 28 to communicate with the space between the beer in the keg and the top 14 of the keg.

Figure 3:
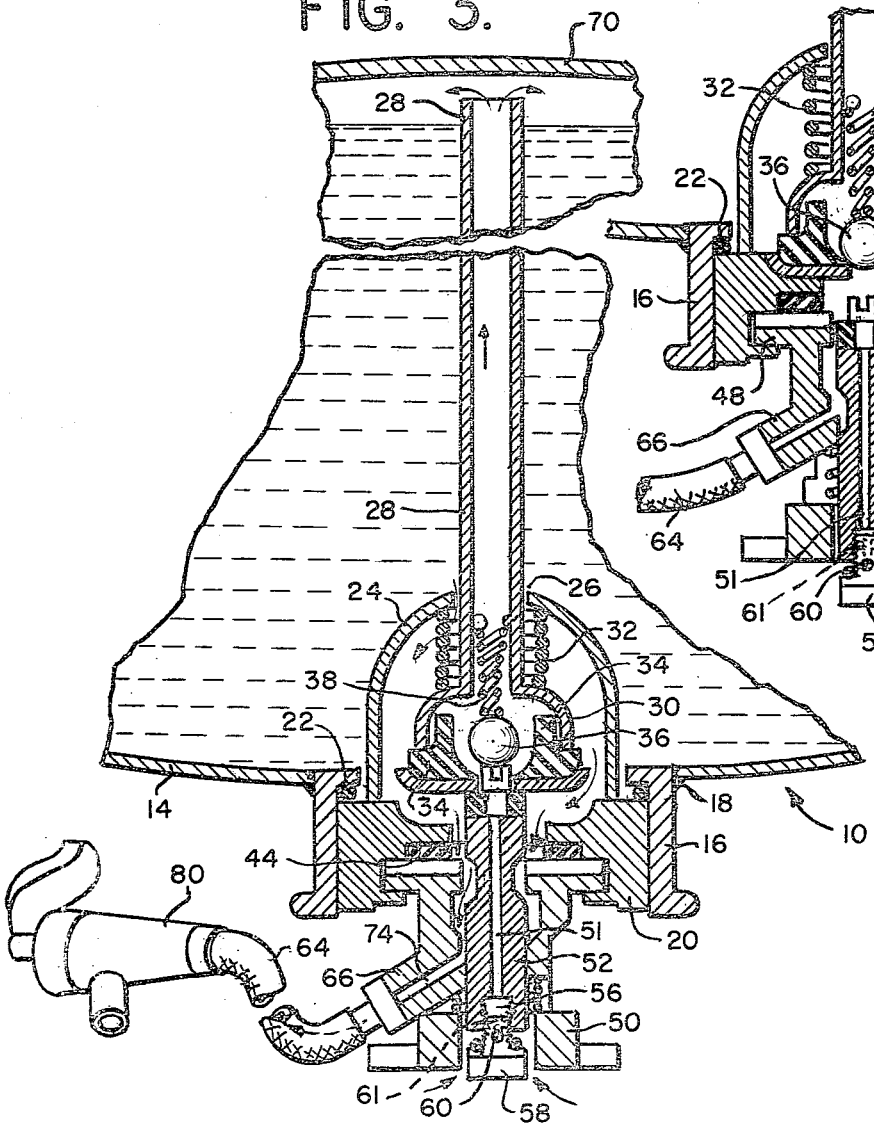
FIG. 3 is a view similar to FIG. 2 but showing the keg valve opened by the tap so that beer flows from the keg through the hose that will ordinarily supply gas, and the line through which the beer would ordinarily be dispensed is open for entrance of air through the valve assembly and upward through the down tube into the space above the beer.

FIG. 3 shows the keg 10 upside down so that the down tube 28 extends close to the end of the keg indicated by the reference character 70, this end being the bottom of the keg when the keg is being used to dispense beer in the usual way and with the keg oriented right side up.

If the keg 10 is so full, when turned upside down that the level of the beer in the keg is higher than the upper end of the down tube 28, then the down tube will be filled by beer flowing over the top edge of the down tube. The purge plug 58 is rotated so as to bring the cross drilling 60 in the plug 58 beyond the enlarged axial passage 56 and beer in the down tube 28 flows out through the cross drilling in the plug 58. As soon as all of the beer above the top edge of the down tube 28 has flowed out through the purge plug 58, air from the ambient atmosphere will enter the cross drilling in the plug 58 and flow along the axial passage in the plunger 52 and through the cross slot in the end of the plunger which contacts with the spherical valve element 36. This air then rises through the down tube 28, as indicated by the arrows in FIG. 3, and flows into the interior of the beer keg above the level of the beer so that beer in the upside down keg can flow downward around the enlarged end of the down tube and along the space on the outside of the plunger 52 and into a passage 74 which communicates with the branch passage 66 and the hose 64 which leads to a faucet 80 having a handle that can be depressed when beer is to be withdrawn by gravity flow from the upside down keg shown in FIG. 3.

The preferred embodiment of the invention has been illustrated and described but changes and modifications can be made and some features can be used in different combinations without departing from the invention as defined in the claims.

What is claimed is:

1. Apparatus for dispensing beer, or the like, including a keg containing beer under pressure, a valve fitting opening through one end of the keg, a down tube extending from the valve fitting to a location adjacent to the other end of the keg, a first passage in the valve fitting, a valve movable between a closed position that shuts off the communication between the first passage and the down tube and another position that puts the first passage in communication with the down tube, a branch passage that communicates with the interior of the valve fitting that surrounds the first passage without communicating with said first passage in the valve fitting, a beer dispensing conduit communicating with the branch passage for dispensing beer from the keg when the keg is oriented with the valve fitting at the bottom of the keg, said valve having a control element by which said valve can be opened for flow of gas through the down tube when the keg is upside down and the liquid in the keg is at a level lower than the end of the down tube.

2. The apparatus for dispensing beer as described in claim 1 characterized by means for operating the control element of said valve to purge from the keg any beer in the keg above the top of the down tube when the keg is upside down and so full of beer that the level of the beer is above the end of the down tube which is remote from the valve fitting and the keg is oriented with the valve fitting at the lower end of the keg.

3. The apparatus for dispensing beer as described in claim 2 characterized by the beer dispensing conduit of the valve fitting having a threaded end portion at a location beyond the sides of the keg for optionally holding a purge element or a hose fitting leading to a faucet at the end of the hose remote from the valve fitting.

4. The method of withdrawing beer, or other liquid, from a keg containing beer under pressure that has a sidewall of generally circular cross section and end walls that close the ends of the keg, locating a valve fitting in the upper end wall of the keg, providing a shutoff valve in said valve fitting, the shutoff valve having an outlet that communicates with a down tube in the keg when the valve is moved into an open position, locating a gas passage in the valve fitting with the gas passage communicating with the interior of the keg above the level of the beer in the keg and not communicating with the down tube and the outlet of the valve fitting when the valve is closed, and locating a conduit leading from a second passage of the valve fitting, characterized by locating the keg in an upside down position with the valve fitting at the bottom of the keg and with the upside down keg containing beer to a level lower than the end of the down tube that is remote from the valve fitting, controlling the withdrawing of beer from the keg by a valve that opens and closes the gas passage when the keg is upside down, and controlling the entrance of air into the down tube and into the space above the beer in the keg by opening and closing the valve in said valve fitting.

5. The method described in claim 4 characterized by supporting the keg while upside down from a surface by a clearance that provides access to the first valve fitting by a hand of a person operating the keg.

6. The method described in claim 4 characterized by holding the keg in its upside down position by supporting it from a substantially horizontal surface with the lowermost end of the keg spaced from said surface by a distance that leaves space for reaching under the keg to operate the valve manually to open and close said valve for starting and stopping the flow of air into the down tube and through the down tube to the space above the liquid in the keg, and discharging beer from the keg through a flexible hose that extends from the passage that constitutes the gas passage of the fitting when the keg is used with the valve fitting at the upper end of the keg, and attaching a beer dispensing valve to the discharge end of the flexible hose.

* * * * *